US011607895B2

(12) United States Patent
Inoue

(10) Patent No.: US 11,607,895 B2
(45) Date of Patent: Mar. 21, 2023

(54) PRINTING APPARATUS INCLUDING A DETACHABLE STAR WHEEL

(71) Applicant: Seiko Epson Corporation, Tokyo (JP)

(72) Inventor: Yuki Inoue, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/409,257

(22) Filed: Aug. 23, 2021

(65) Prior Publication Data

US 2022/0055383 A1 Feb. 24, 2022

(30) Foreign Application Priority Data

Aug. 24, 2020 (JP) ..... JP2020-140702

(51) Int. Cl.

| | |
|---|---|
| ***B41J 11/28*** | (2006.01) |
| ***B41J 11/00*** | (2006.01) |
| ***B41J 11/06*** | (2006.01) |
| ***B41J 11/32*** | (2006.01) |
| ***B41J 11/34*** | (2006.01) |
| *B41J 11/30* | (2006.01) |

(52) U.S. Cl.

CPC ..... *B41J 11/28* (2013.01); *B41J 11/005* (2013.01); *B41J 11/06* (2013.01); *B41J 11/32* (2013.01); *B41J 11/34* (2013.01); *B41J 11/30* (2013.01)

(58) Field of Classification Search

CPC . B41J 11/28; B41J 11/005; B41J 11/06; B41J 11/32; B41J 11/34; B41J 11/30

See application file for complete search history.

(56) References Cited

U.S. PATENT DOCUMENTS 5,368,403 A * 11/1994 Broder ..... B41J 29/02 400/354
5,420,621 A * 5/1995 Richtsmeier ..... B41J 13/03 271/10.04
2016/0288539 A1 10/2016 Yanagisawa et al.

FOREIGN PATENT DOCUMENTS

JP 2016-193561 11/2016

* cited by examiner

*Primary Examiner* — Henok D Legesse
(74) *Attorney, Agent, or Firm* — Workman Nydegger

(57) ABSTRACT

A printing apparatus includes: a head configured to discharge an ink onto a continuous sheet to form an image; a platen including a support face that supports the continuous sheet; a star-wheel-unit holding unit disposed at a position that is downstream of the head in a transport direction of the continuous sheet and is opposed to the support face; and a star wheel unit configured to be attachable to and detachable from the star-wheel-unit holding unit and to support a plurality of star wheels configured to press the continuous sheet on a side of the support face.

6 Claims, 6 Drawing Sheets

PRINTING APPARATUS INCLUDING A DETACHABLE STAR WHEEL

The present application is based on, and claims priority from JP Application Serial Number 2020-140702, filed on Aug. 24, 2020, the disclosure of which is hereby incorporated by reference herein in its entirety.

BACKGROUND

1. Technical Field

The present disclosure relates to a printing apparatus.

2. Related Art

There is a known printing apparatus that includes a star wheel to prevent a medium from floating from a platen that supports the medium. In a case of such a printing apparatus, a paper jam may occur between the star wheel and the platen. JP-A-2016-193561 discloses a printer in which a star-wheel supporting member that supports the star wheel can be moved to a position spaced apart from the platen surface.

However, the printing apparatus described in JP-A-2016-193561 has a structure in which the star wheel unit that supports the star wheel is slightly retracted upward from the support face that supports the medium on the platen, which results in a problem in that it is difficult to remove a medium with paper jam.

SUMMARY

A printing apparatus includes a head configured to discharge an ink onto a medium to form an image, a platen including a support face that supports the medium, a star-wheel-unit holding unit disposed at a position that is downstream of the head in a transport direction of the medium and is opposed to the support face, and a star wheel unit configured to be attachable to and detachable from the star-wheel-unit holding unit and to support a plurality of star wheels configured to press the medium on a side of the support face.

DESCRIPTION OF EXEMPLARY EMBODIMENTS

1. Embodiment

Figure 1:
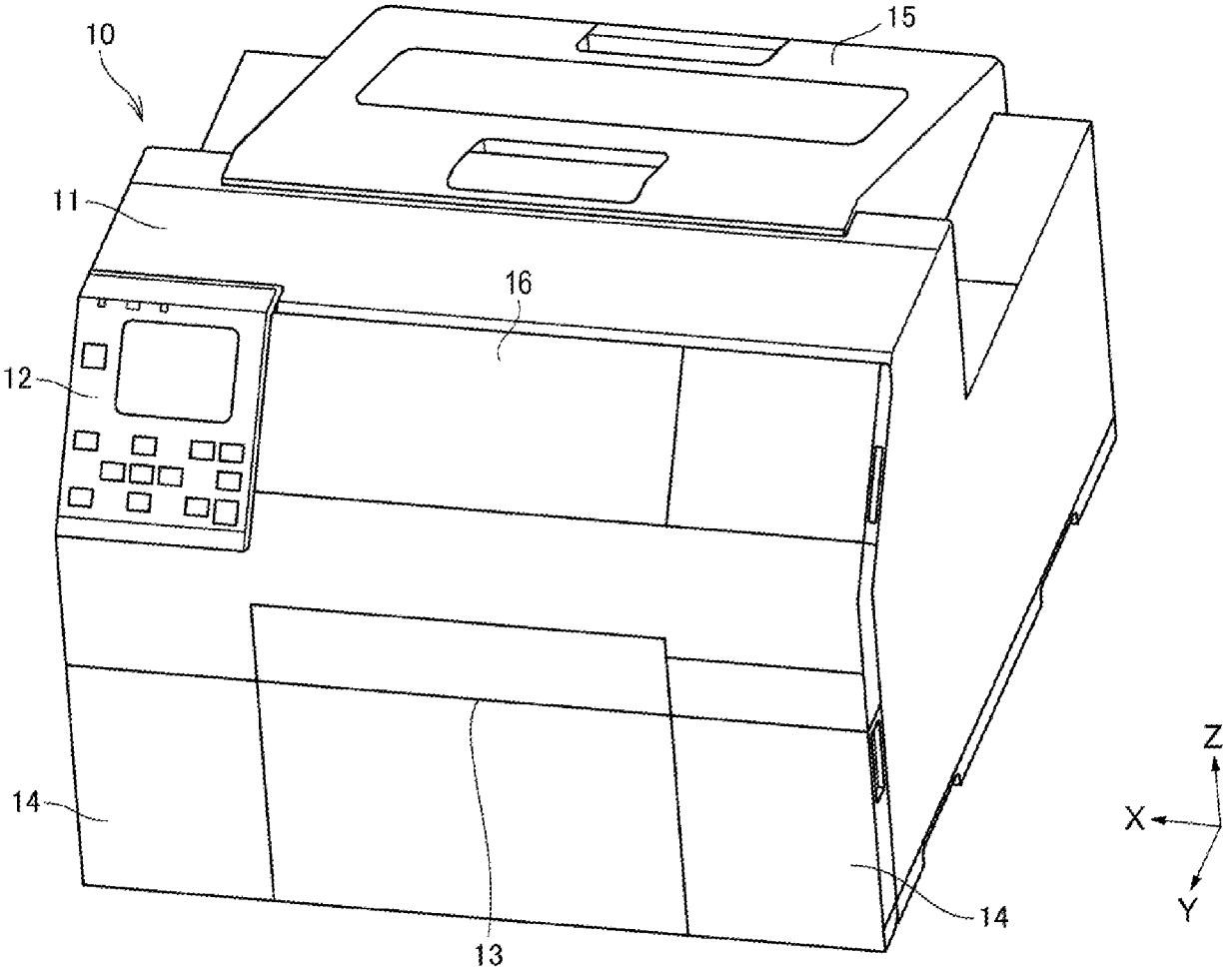
FIG. 1 is a perspective view illustrating an overall configuration of a printing apparatus according to an embodiment.

The configuration of a printing apparatus 10 will be described with reference to FIGS. 1 and 2. In the coordinate attached in the drawings, on the assumption that the printing apparatus 10 is placed on the horizontal plane, three imaginary axes intersecting each other at right angles are each set as an X-axis, a Y-axis, and a Z-axis. The Y-axis is an axis extending in parallel to the front-rear direction of the printing apparatus 10, and the tip side of the arrow indicating the Y-axis is set as "front". The X-axis is an axis extending in parallel to the left-right direction of the printing apparatus 10, and the tip side of the arrow indicating the X-axis is set as "left". The Z-axis is an axis extending in parallel to the vertical direction, and the tip side of the arrow indicating the Z-axis is set as "up". In addition, the tip side of the arrow indicating each of the axes is set as "+ direction", and the base end side is set as "− direction".

The printing apparatus 10 is a printer that performs printing on a continuous sheet S serving as a medium and including a label sheet on which labels are attached on an elongated mount at regular intervals, and is also referred to as a label printer. The printing apparatus 10 is coupled to an information processing terminal in a wired or wireless manner through a USB cable or LAN, and performs printing on the basis of print data transmitted from the information processing terminal. The USB stands for a universal serial bus. The LAN stands for a local area network.

Figure 2:
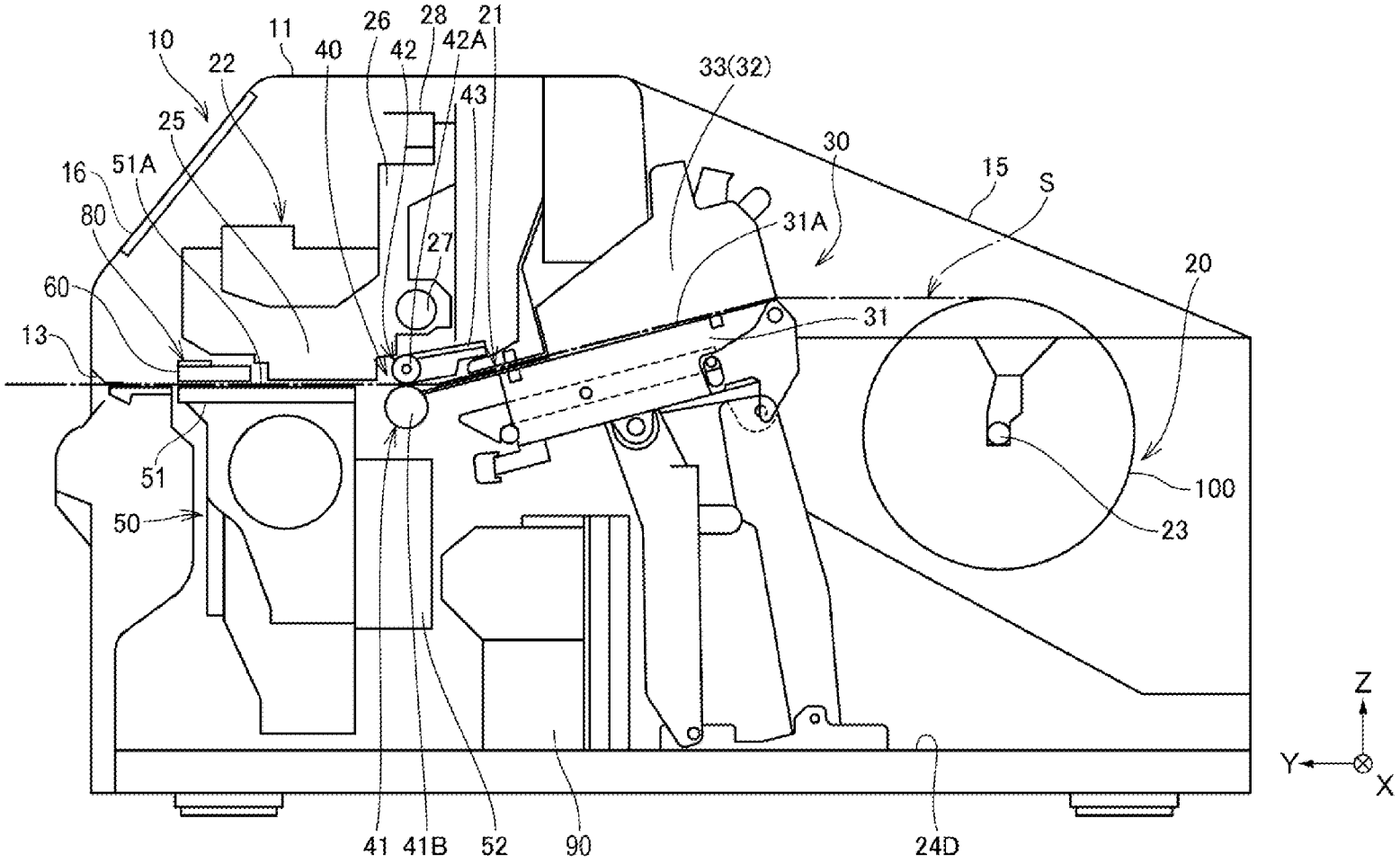
FIG. 2 is a cross-sectional view illustrating the overall configuration of the printing apparatus.

The printing apparatus 10 includes a case 11 that constitutes a housing of this printing apparatus 10, as illustrated in FIGS. 1 and 2. An operating panel 12 including an operating button or the like is provided at an upper portion on the left side on the front surface that corresponds to the +Y direction of the case 11. A slit-shaped paper exit 13 from which a continuous sheet S after printing is emitted is provided at a central portion of the front face of the case 11. A mounting-portion cover 14 that covers a mounting portion used to mount an ink cartridge is provided at each of both sides of the paper exit 13 along the X-axis. The mounting-portion cover 14 is opened or closed at the time of replacing an ink cartridge.

A guide-unit cover 15 is provided at an upper surface of the case 11 in the +Z direction. This guide-unit cover 15 is moved to an open position to be opened, whereby a guide unit 30 provided in a transport path 21 for the continuous sheet S is exposed. The guide-unit cover 15 includes a hinge provided at the rear end portion and having a shaft center extending in parallel to the X-axis, and can rotate about the hinge between the open position and the close position.

A printing-unit cover 16 is provided at the right side of the operating panel 12. This printing-unit cover 16 is moved to the open position to be opened, whereby a printing unit 22 that forms an image on the continuous sheet S is exposed. The printing-unit cover 16 includes a hinge provided at the upper end portion and having a shaft center extending in parallel to the X-axis, and can rotate about the hinge between the open position and the close position. The printing-unit cover 16 is opened or closed at the time of maintenance of the printing unit 22 or removing a continuous sheet S with paper jam occurring in the printing unit 22.

The printing apparatus 10 includes: an accommodation unit 20 in which a roll paper 100 obtained by winding the continuous sheet S in a rolled manner is accommodated; a transport path 21 extending from the accommodation unit 20 toward the paper exit 13 of the case 11; and the printing unit 22 configured to perform printing on the continuous sheet S at a predetermined position in the transport path 21. In this embodiment, the configuration using the roll paper 100 as the continuous sheet S will be described. In addition, the transport direction represents a direction in which the continuous sheet S is transported along the transport path 21 from the accommodation unit 20 toward the paper exit 13. Furthermore, the width direction represents a direction perpendicular to the transport direction.

Note that the continuous sheet S is not limited the label sheet, and various types of continuous sheets S may be used. For example, it may be possible to use a sheet folded along perforations provided so as to be spaced apart in the longitudinal direction, namely, a fanfold sheet.

In the case 11, the accommodation unit 20 is disposed below the guide-unit cover 15. The roll paper 100 is rotatably supported by the side wall portion of the accommodation unit 20 through a roll paper rotary shaft 23.

The guide unit 30 is disposed in the +Y direction of the accommodation unit 20. The guide unit 30 functions to guide a paper sheet of the continuous sheet S. The guide unit 30 includes a guide stage 31 that can support a lower surface of the continuous sheet S pulled out of the accommodation unit 20. The guide stage 31 includes an upper surface plate 31A extending in the width direction and sloped downward toward the front direction. The guide stage 31 supports a fixed guide 32 and a movable guide 33 each having a side wall shape and configured to guide both ends of the continuous sheet S in the width direction. The fixed guide 32 is fixed at a side of the −X direction of the upper surface plate 31A. The movable guide 33 is supported so as to be able to slide in the width direction of the upper surface plate 31A so that the movable guide 33 can move toward and away from the fixed guide 32.

At the time of adjusting the positions of the guides 32 and 33 in accordance with the sheet width of the continuous sheet S, the printing apparatus 10 adjust the position of the movable guide 33 in a state where a side end of the continuous sheet S is in contact with the fixed guide 32. The fixed guide 32 and the movable guide 33 guide the positions of the side ends of the continuous sheet S. The fixed guide 32 and the movable guide 33 extend in the transport direction of the continuous sheet S. The side end of the continuous sheet S that is in contact with the fixed guide 32 is always aligned at the same location in the width direction regardless of the sheet width of the continuous sheet S. The continuous sheet S is transported on the basis of the position of the fixed guide 32 side.

Figure 3:
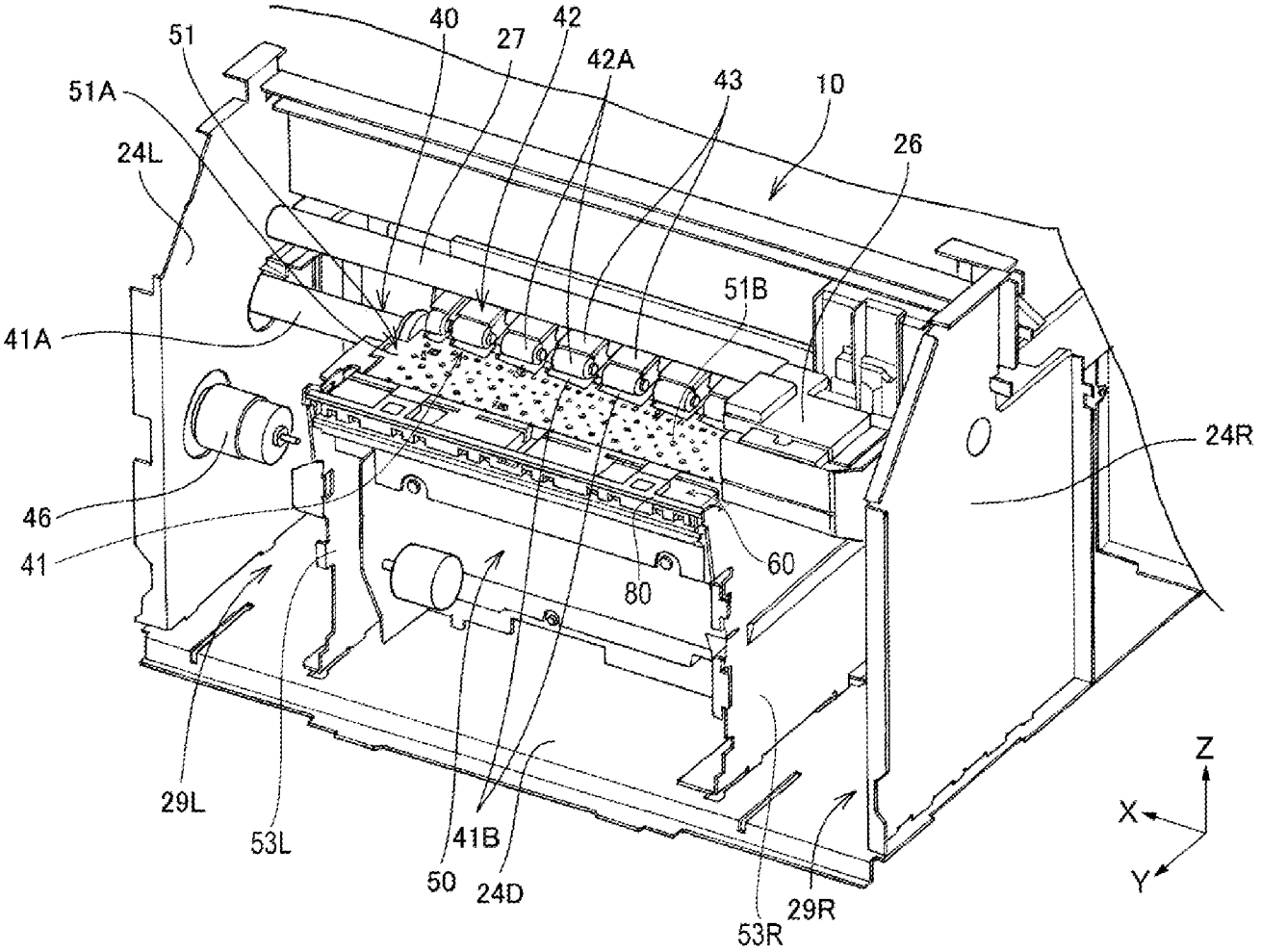
FIG. 3 is a partial perspective view illustrating an internal structure of the printing apparatus.

As illustrated in FIGS. 2 and 3, the printing apparatus 10 includes a planar-plate-shaped bottom frame 24D, and side frames 24L and 24R having a side wall shape and standing at both side end portions of the bottom frame 24D in a direction along the X-axis. The bottom frame 24D and the side frames 24L and 24R are covered with the case 11.

The side frames 24L and 24R support the paper feed roller 40. The paper feed roller 40 is provided downstream of the guide unit 30 in the transport direction. The paper feed roller 40 includes a driving roller 41 and a driven roller 42 that is opposed to the driving roller 41.

The driving roller 41 includes a shaft portion 41A extending in the width direction, and a roller portion 41B provided on the shaft portion 41A and having a diameter larger than the shaft portion 41A. The driving roller 41 is rotatably supported by the side frames 24L and 24R. The roller portion 41B is provided on the shaft portion 41A so as to be spaced apart in the axial direction.

The driven roller 42 is disposed above the driving roller 41. The driven roller 42 includes a roller main body 42A. The roller main body 42A is provided for each roller portion 41B of the driving roller 41, and is disposed so as to be opposed to the roller portion 41B. The roller main body 42A is supported by an arm 43 extending along the Y-axis. At an end of the arm 43 in the +Y direction, the roller main body 42A is supported rotatably about the center of rotation extending in the width direction. At the end portion in the −Y direction, the arm 43 is supported by the side frames 24L and 24R rotatably about the center of rotation extending in the width direction. The arm 43 is energized by an energizing member, which is not illustrated, in a manner such that the roller main body 42A is pressed against the driving roller 41. The continuous sheet S is sandwiched between the driving roller 41 and the driven roller 42, and is transported.

The side frame 24L on the side of the +X direction supports a transport motor 46. The transport motor 46 transmits power to the driving roller 41 through a power transmission member, which is not illustrated. The transport motor 46 is configured so as to be able to drive in both forward and reverse directions, and causes the driving roller 41 to rotate in forward and reverse directions. Upon driving of the transport motor 46, the driving roller 41 drives. In addition, the driven roller 42 pressed against the driving roller 41 rotates in a following manner in association with rotation of the driving roller 41.

A printing unit 22 is disposed downstream of the paper feed roller 40 in the transport direction. The printing unit 22 includes a head 25 configured to discharge an ink onto the continuous sheet S to form an image. The head 25 is mounted on a carriage 26. The carriage 26 is supported so as to be able to move in the width direction along a carriage shaft 27 extending in the width direction. In addition, the carriage 26 is supported so as to be able to move along a guide frame 28 provided between the side frame 24L and the side frame 24R. With the carriage 26 moving along the carriage shaft 27 and the guide frame 28, the head 25 is caused to move in a main scanning direction along the X-axis.

The head 25 includes a plurality of nozzle rows corresponding to, for example, four colors CYMK of inks. The head 25 receives supply of ink from an ink cartridge, which is not illustrated, and discharges inks from nozzles provided in each of the nozzle rows to form dots on the continuous sheet S to print an image.

As illustrated in FIG. 3, below the printing unit 22, an interior frame 53R in parallel to the side frame 24R stands from the bottom frame 24D, and an interior frame 53L in parallel to the side frame 24L stands from the bottom frame 24D. An ink cartridge mounting portion 29R is provided between the side frame 24R and the interior frame 53R. In addition, an ink cartridge mounting portion 29L is provided between the side frame 24L and the interior frame 53L. Ink cartridges mounted on the ink cartridge mounting portions 29L and 29R are coupled to the head 25 by way of a pressurizing pump unit 90 illustrated in FIG. 2 and through tubes, which are not illustrated. The pressurizing pump unit 90 drives to pressurize the ink cartridges, whereby the inks are supplied to the head 25.

Note that the number of colors of inks that the printing apparatus 10 uses is not limited to four colors. For example, it may be possible to employ a configuration in which printing is performed with a plurality of colors of inks including spot color inks in addition to four colors CMYK. Furthermore, the printing apparatus 10 may have a configuration in which printing is performed in monochrome or using two-color ink.

A platen unit 50 is disposed at a position that is opposed to the head 25. The platen unit 50 includes a platen 51 including a support face 51A that supports the continuous sheet S located between the paper feed roller 40 and the paper exit 13 in the transport direction. The platen 51 extends in the width direction over an area where dots can be formed with the head 25. Both ends of the platen 51 in the width direction are provided at upper end portions of the interior frames 53R and 53L.

A region of the support face 51A that is opposed to the head 25 includes a plurality of suction holes 51B extending through the platen 51 in the Z direction. The suction holes 51B communicate with a suction fan 52 that generates a suction force in the suction holes 51B. The continuous sheet S located in the region that is opposed to the head 25 is transported in a state of being sucked toward the suction holes 51B. This makes it possible to suppress floating of the continuous sheet S from the platen 51, and to appropriately maintain the distance between the continuous sheet S and the head 25.

A star wheel unit 60 is provided above the region of the support face 51A that is located downstream of the head 25. The star wheel unit 60 supports a plurality of star wheels 65 that can hold the continuous sheet S toward the support face 51A side. This makes it possible to prevent the continuous sheet S after printing from floating from the support face 51A, and to favorably emit the continuous sheet S from the paper exit 13.

The interior frames 53R and 53L include a star-wheel-unit holding unit 80 that holds the star wheel unit 60 in a detachable manner. The star-wheel-unit holding unit 80 is provided downstream of the head 25 in the transport direction and at a position that is opposed to the support face 51A. The star-wheel-unit holding unit 80 according to this embodiment is formed of a plate-shape frame extending in the width direction, and both ends of the frame are coupled to upper ends of the interior frames 53R and 53L. The star-wheel-unit holding unit 80 is provided above the upper end of the downstream side of the platen 51. The star-wheel-unit holding unit 80 covers the upper surface along the end portion, at the downstream side, of the star wheel unit 60 in a state where the star wheel unit 60 is held by the star-wheel-unit holding unit 80. In other words, the plane area of the plate-shape frame is smaller than the plane area of the star wheel unit 60.

A cutter unit configured to cut the continuous sheet S can be mounted downstream of the platen 51. The cutter unit may be a unit configured to cut the continuous sheet S by leaving part of the continuous sheet S uncut in the width direction or may be a unit configured to completely cut the continuous sheet S. The printing apparatus 10 uses the cutter unit to cut the continuous sheet S printed with the head 25 into a predetermined length, thereby being able to make it exit from the paper exit 13.

Figure 4:
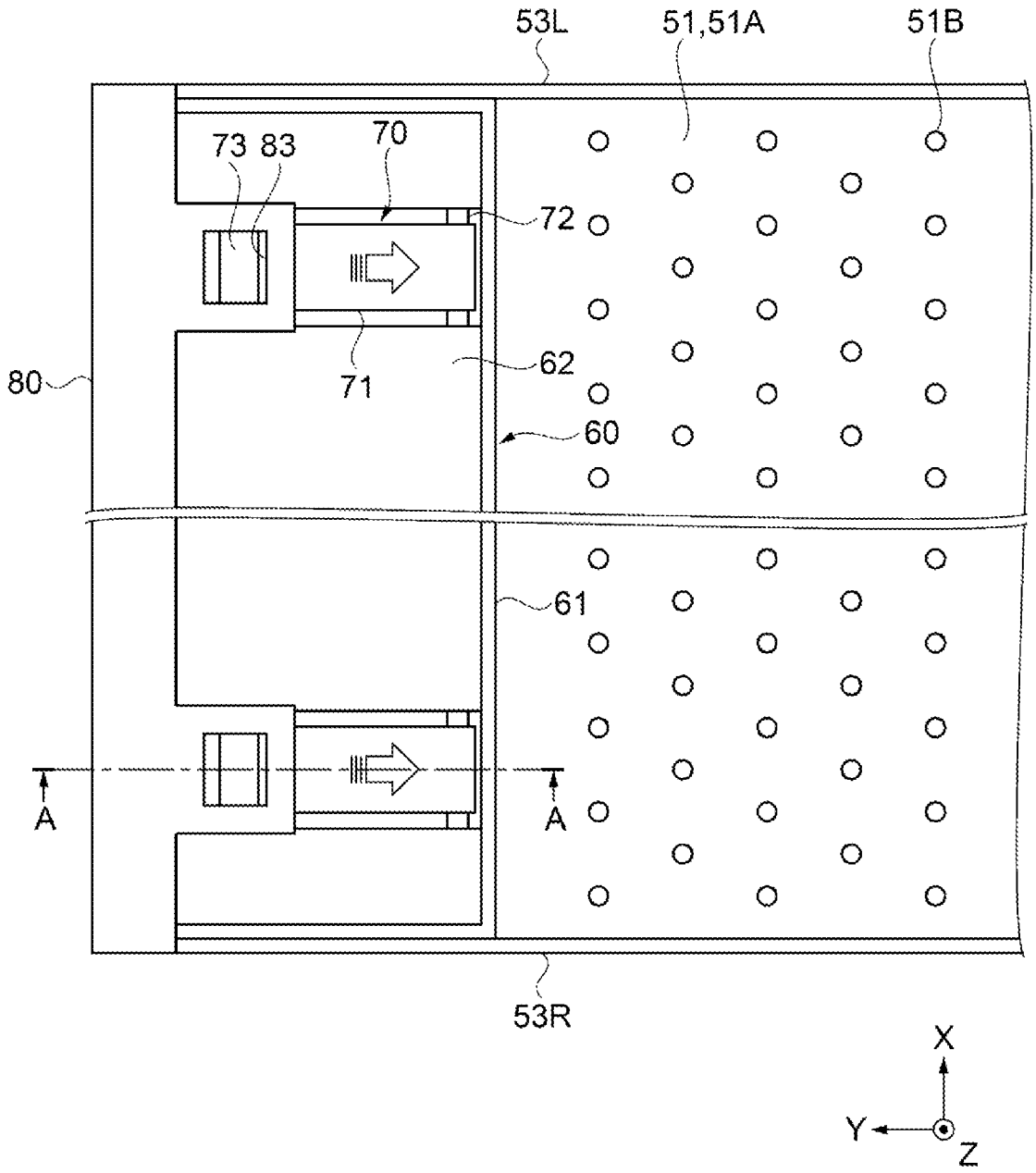
FIG. 4 is a plan view illustrating a state in which a star wheel unit is held by a star-wheel-unit holding unit.
Figure 5:
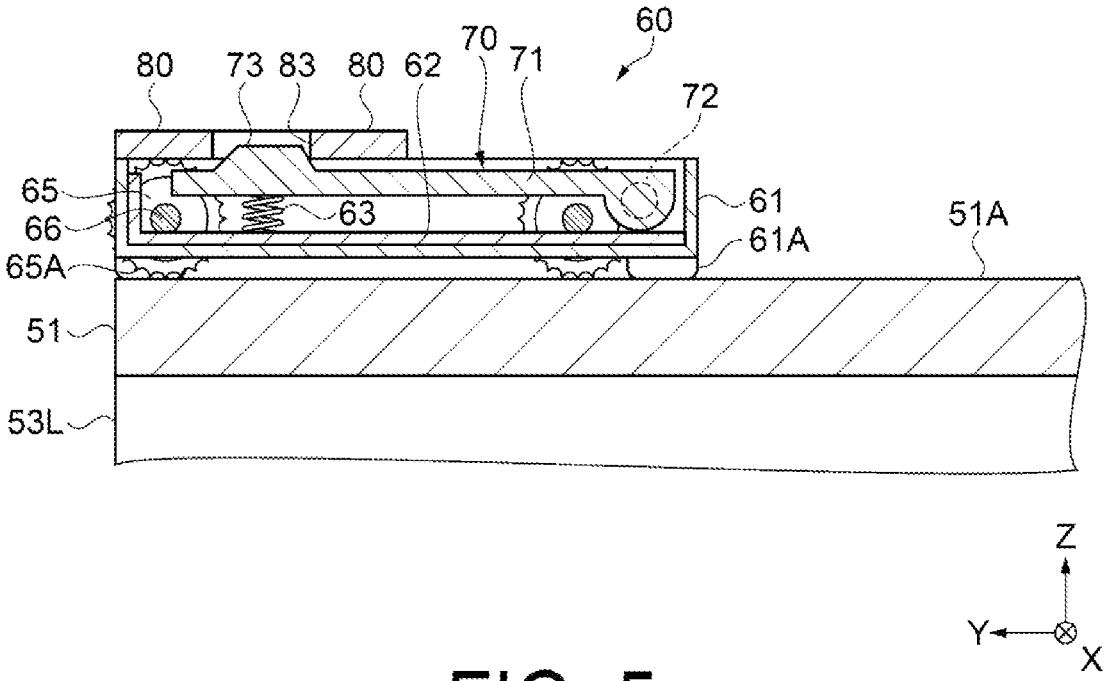
FIG. 5 is a cross-sectional view taken along the line A-A in FIG. 4.

Next, the configurations of the star-wheel-unit holding unit 80 and the star wheel unit 60 will be described with reference to FIGS. 4 to 7. FIGS. 4 and 5 are schematic views each illustrating a state in which the star wheel unit 60 engages with the star-wheel-unit holding unit 80.

The star-wheel-unit holding unit 80 includes a first engaging portion 83 used to cause the star wheel unit 60 to engage in a detachable manner.

The star wheel unit 60 includes a star wheel frame 61, a star wheel holder 62, a star wheel 65, and a lever portion 70.

The star wheel holder 62 is a box-shaped resin member used to hold, therein, the star wheel 65, the lever portion 70, and the like. The star wheel frame 61 is a box-shaped steel member having an upper surface opened. The star wheel frame 61 accommodates the star wheel holder 62 in which the star wheel 65, the lever portion 70, and the like are built in. In addition, the star wheel frame 61 includes a protruding portion 61A disposed at both ends thereof in the width direction and protruding downward from the bottom surface thereof. This protruding portion 61A works to keep a constant space between the bottom surface of the star wheel unit 60 and the support face 51A of the platen 51.

The star wheel 65 includes a plurality of protrusions 65A provided at constant angular pitches on the outer peripheral edge. The star wheel 65 includes a rotational movement shaft 66 extending in the width direction, and is held by the star wheel holder 62 in a rotatable manner. A plurality of the star wheels 65 are provided so as to be spaced apart from each other in the width direction. The plurality of star wheels 65 provided in the width direction are disposed upstream and downstream in the transport direction.

The continuous sheet S transported to a region of the support face 51A in which no suction hole 51B is provided may float from the support face 51A due to curly sheet resulting from being wound in a roll manner or paper sheet being swollen after printing or the like. The star wheel 65 is configured so as to be able to press the continuous sheet S floating from the support face 51A, toward the support face 51A in a direction perpendicular to the support face 51A. A portion of the protrusion 65A of the star wheel 65 is brought into contact with the continuous sheet S while rotating in a following manner with respect to the transported continuous sheet S. This results in a reduced contact area with the continuous sheet S, which makes it possible to transport the continuous sheet S to the paper exit 13 in a manner that reduces a degradation in quality of an image recorded on the continuous sheet S.

The lever portion 70 includes a plate-shape lever main body 71, a rotational movement shaft 72 extending in the width direction, and a second engaging portion 73 engaging with the first engaging portion 83. The rotational movement shaft 72 is provided upstream of the lever main body 71, and is held by the star wheel holder 62 in a rotatable manner. The second engaging portion 73 is provided on the upper surface and downstream of the lever main body 71. The lever portion 70 is configured such that the second engaging portion 73 can be displaced in the Z direction with respect to the first engaging portion 83 with the rotational movement shaft 72 being the fulcrum.

The star wheel unit 60 includes an elastic member 63 configured to press the lever portion 70 toward the star-wheel-unit holding unit 80 side in an engaged state where the first engaging portion 83 of the star-wheel-unit holding unit 80 and the second engaging portion 73 engage with each other. A coil spring or the like can be used as the elastic member 63, and is mounted between the lever main body 71 and the inner bottom surface of the star wheel holder 62.

Either one of the first engaging portion 83 and the second engaging portion 73 has a convex shape, and the other one of the first engaging portion 83 and the second engaging portion 73 has a concave shape or is configured as a through-hole. In addition, either one of the first engaging portion 83 and the second engaging portion 73 is formed as a sloped surface or a curved surface at a position where the first engaging portion 83 and the second engaging portion 73 are brought into contact with each other in an engaged state. In this embodiment, the first engaging portion 83 is formed as a through-hole. The second engaging portion 73 is formed so as to have a convex shape. A sloped surface is formed on the second engaging portion 73.

Figure 6:
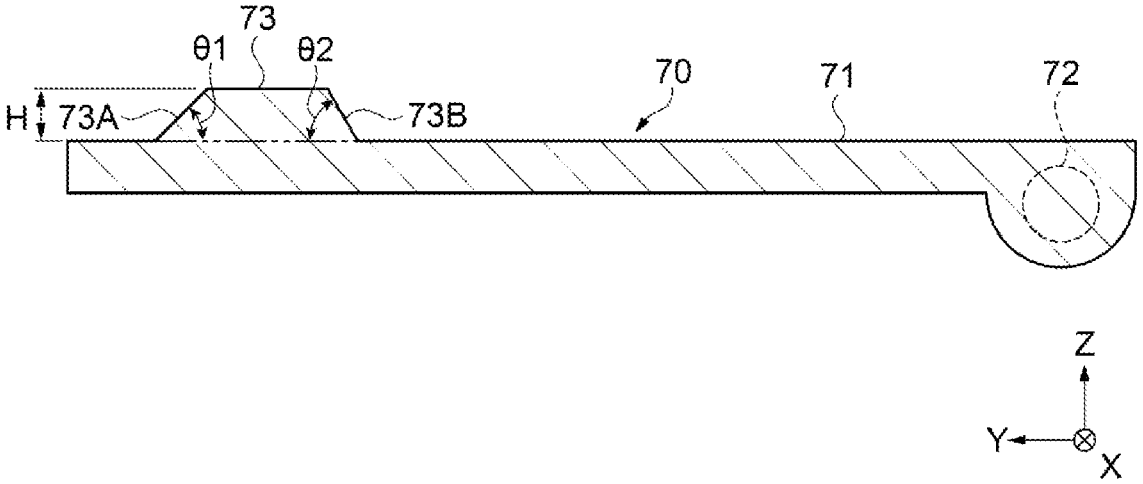
FIG. 6 is an enlarged cross-sectional view illustrating the shape of a lever portion.

As illustrated in FIG. 6, the second engaging portion 73 includes a first sloped surface 73A located at the +Y direction and a second sloped surface 73B located at the −Y direction, as viewed from the side in the X direction. In addition, the second engaging portion 73 has a convex shape that is raised from the level main body 71 in the +Z direction and into a trapezoid shape. Furthermore, the second engaging portion 73 has a rectangular shape in plan view from the +Z direction. The height H of protrusion of the second engaging portion 73 is approximately 2 mm. A first slope angle θ1 formed by the first sloped surface 73A and the upper surface of the lever main body 71 is 45°, and a second slope angle θ2 formed by the second sloped surface 73B and the upper surface of the lever main body 71 is 60°.

The first engaging portion 83 is a frame-shape member including a through-hole that fits the convex shape of the second engaging portion 73. In an engaged state, the second sloped surface 73B comes into contact with the first engaging portion 83.

By moving in a direction parallel to the transport direction, the star wheel unit 60 can be attached to or detached from the star-wheel-unit holding unit 80.

FIG. 4 illustrates an engaging state in which the first engaging portion 83 of the star-wheel-unit holding unit 80 and the second engaging portion 73 of the star wheel unit 60 engage with each other. An arrow is illustrated on the lever main body 71 of the lever portion 70 including the second engaging portion 73. The arrow indicates a direction in which the star wheel unit 60 is moved with respect to the star-wheel-unit holding unit 80 in order to release the engagement.

Figure 7:
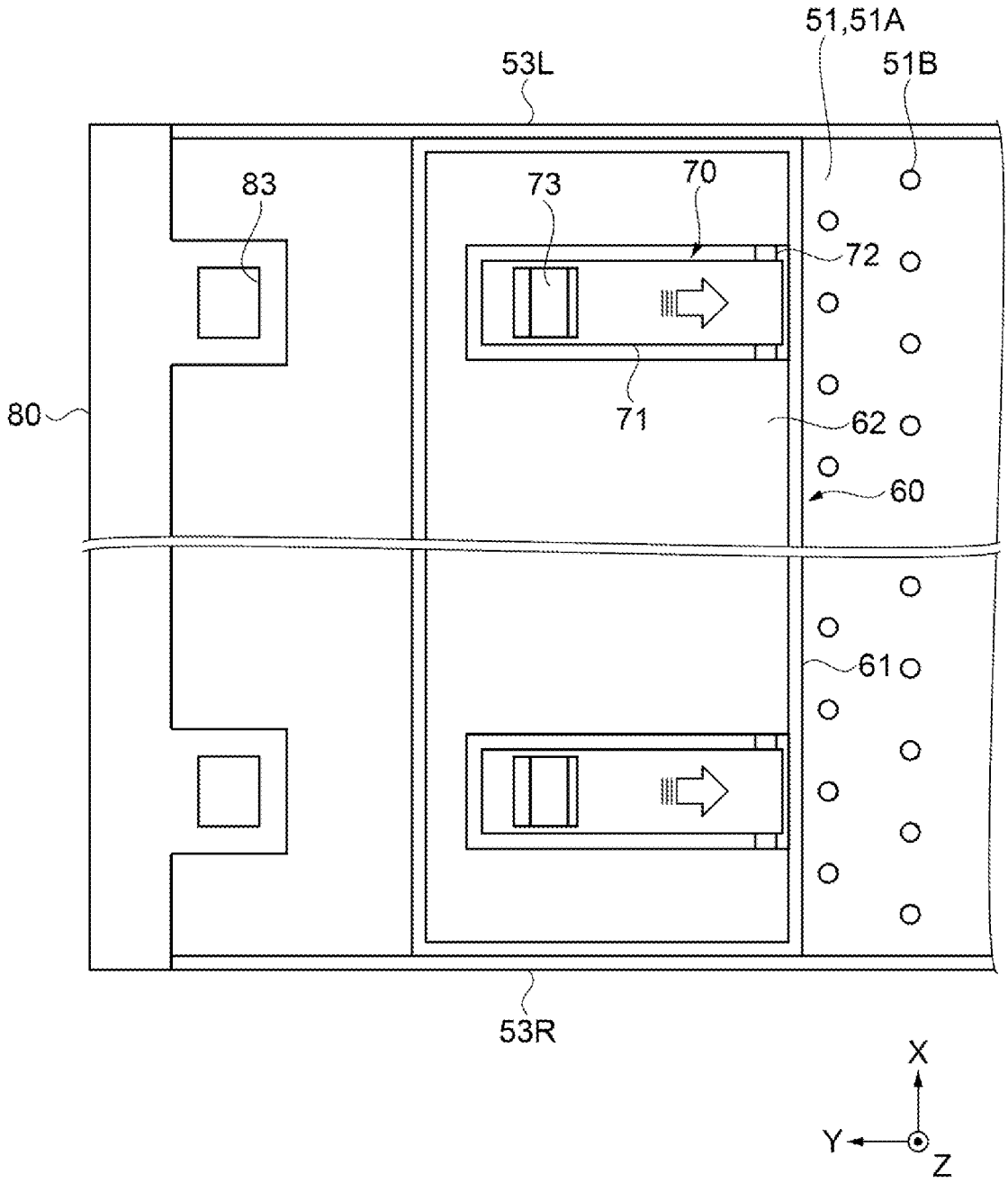
FIG. 7 is a plan view illustrating a state in which the star wheel unit is removed from the star-wheel-unit holding unit.

In a state illustrated in FIG. 4, a user moves the star wheel unit 60 in the arrow direction against the pressing force of the elastic member 63 in a state where the lever main body 71 is depressed. This releases the engagement between the first engaging portion 83 and the second engaging portion 73. Thus, it is possible to detach the star wheel unit 60 from the star-wheel-unit holding unit 80 as illustrated in FIG. 7. In this embodiment, it is possible to detach by moving the star wheel unit 60 in the −Y direction parallel to the transport direction.

In a state illustrated in FIG. 7, a user moves the star wheel unit 60 in a direction opposite to the arrow direction in a state where the lever main body 71 is depressed, which allows the first engaging portion 83 and the second engaging portion 73 to engage with each other. This makes it possible to attach the star wheel unit 60 to the star-wheel-unit holding unit 80 to hold it, as illustrated in FIG. 4. In this embodiment, the star wheel unit 60 is moved in the +Y direction parallel to the transport direction, which makes it possible to mount it.

The first slope angle θ1 of the first sloped surface 73A is formed so as to be flatter than the second slope angle θ2 of the second sloped surface 73B. This makes it possible to easily attach the star wheel unit 60 to the star-wheel-unit holding unit 80.

The second slope angle θ2 of the second sloped surface 73B is steeper than the first slope angle θ1 of the first sloped surface 73A. In addition, the second sloped surface 73B presses the first engaging portion 83. This makes it possible to suppress unintended detachment of the star wheel unit 60 from the star-wheel-unit holding unit 80. Furthermore, as a counterforce of the elastic member 63, the first engaging portion 83 generates a force that presses the star wheel unit 60 toward the platen 51 side. This suppresses rotation of the star wheel unit 60 with respect to the star-wheel-unit holding unit 80, which causes the star wheel unit 60 to be fixed at a predetermined position.

It should be noted that this embodiment gives an example of a configuration in which the first engaging portion 83 is a through-hole, and the second engaging portion 73 has a convex shape. However, the first engaging portion may have a convex shape, and the second engaging portion may be a through-hole. In addition, the through-hole may have a concave shape that does not penetrate through. Furthermore, the sloped surfaces of the first sloped surface 73A and the second sloped surface 73B that constitute the convex shape of the second engaging portion 73 may be configured as a curved surface.

As described above, with the printing apparatus 10 according to this embodiment, it is possible to obtain the following effect.

The printing apparatus 10 includes the star-wheel-unit holding unit 80 provided downstream of the head 25 and at a position that is opposed to the support face 51A of the platen 51, and the star wheel unit 60 that supports the star wheel 65 that can press the continuous sheet S. The star wheel unit 60 is configured so as to be able to be attached to or detached from the star-wheel-unit holding unit 80, which makes it possible to easily remove the continuous sheet S with paper jam.

The printing apparatus 10 is configured so as to be able to be attached and detached by moving the star wheel unit 60 in a direction parallel to the transport direction. This makes it possible to easily attach and detach the star wheel unit with respect to the star-wheel-unit holding unit 80.

The star-wheel-unit holding unit 80 includes the first engaging portion 83. The star wheel unit 60 includes the second engaging portion 73. With the first engaging portion 83 and the second engaging portion 73 engaging with each other, the star wheel unit 60 is held by the star-wheel-unit holding unit 80. In the engaged state, the star wheel 65 supported by the star wheel unit 60 presses the continuous sheet S transported along the support face 51A. This makes it possible to suppress floating of the continuous sheet S from the support face 51A.

Either one of the first engaging portion 83 and the second engaging portion 73 is formed as a sloped surface or a curved surface having a convex shape. In the engaged state, this makes it possible to generate a force that presses the star wheel unit 60 toward the platen 51 side to fix the position of the star wheel unit 60.

The star wheel unit 60 includes the lever portion 70 including the second engaging portion 73, which makes it possible to easily attach and detach the star wheel unit 60 with respect to the star-wheel-unit holding unit 80.

The star wheel unit 60 includes an elastic member 63 that presses the lever portion 70 toward the star-wheel-unit holding unit 80 side. This makes it possible to suppress unintended detachment of the star wheel unit 60 from the star-wheel-unit holding unit 80.

The plane area of the plate-shape frame serving as the star-wheel-unit holding unit 80 is smaller than the plane area of the star wheel unit 60. In other words, when the star wheel unit 60 is detached from the star-wheel-unit holding unit 80, the support face 51A of the platen 51 is exposed in plan view from above. Thus, it is possible to easily remove the continuous sheet S with paper jam.

What is claimed is:

1. A printing apparatus comprising:

a head configured to discharge an ink onto a medium to form an image;

a platen including a support face that supports the medium;

a star-wheel-unit holding unit disposed at a position that is downstream of the head in a transport direction of the medium and is opposed to the support face; and a star wheel unit configured to be attachable to and detachable from the star-wheel-unit holding unit and to support a plurality of star wheels configured to press the medium toward a side of the support face, wherein the star wheel unit includes a lever portion that is configured to be displaced so that the star wheel unit is attached to or detached from the star-wheel-unit holding unit, the star wheel unit moving in a direction that is opposite of the transport direction when being detached to thereby cover a portion of the platen that is not covered when the star when unit is attached and moving in a direction that is parallel to the transport unit when being attached.

2. The printing apparatus according to claim 1, wherein the star-wheel-unit holding unit includes a first engaging portion, the star wheel unit includes a second engaging portion, by the first engaging portion and the second engaging portion engaging with each other, the star wheel unit is held by the star-wheel-unit holding unit, and in an engaged state where the first engaging portion and the second engaging portion engage with each other, the star wheel presses the medium floating from the support face.

3. The printing apparatus according to claim 2, wherein one of the first engaging portion and the second engaging portion has a convex shape, the other one of the first engaging portion and the second engaging portion has a concave shape or is a through-hole, and one of the first engaging portion and the second engaging portion is formed as a sloped surface or a curved surface at a position where the first engaging portion and the second engaging portion are in contact with each other in the engaged state.

4. The printing apparatus according to claim 2, wherein the lever portion is configured to be displaced with respect to the first engaging portion, and the lever portion is formed at the second engaging portion.

5. The printing apparatus according to claim 4, wherein the star wheel unit includes an elastic member configured to press the lever portion toward a side of the star-wheel-unit holding unit in the engaged state.

6. The printing apparatus according to claim 1, wherein the star-wheel-unit holding unit is formed of a plate-shape frame, and a plane area of the plate-shape frame is smaller than the plane area of the star wheel unit.

* * * * *